US005764262A

United States Patent [19]

Wu et al.

[11] Patent Number: 5,764,262

[45] Date of Patent: Jun. 9, 1998

[54] PROCESS FOR PROVIDING DURABLE IMAGES ON A PRINTED MEDIUM

[75] Inventors: Zarng-Arh George Wu, Sayre, Pa.; Robert Paul Held, Newark, Del.; Jon Gregory Moehlmann, Sayre, Pa.

[73] Assignee: E. I. du Pont de Nemours and Company, Wilmington, Del.

[21] Appl. No.: 561,734

[22] Filed: Nov. 22, 1995

[51] Int. Cl.[6] ..... B41J 2/01

[52] U.S. Cl. ..... 347/101; 347/102; 347/105

[58] Field of Search ..... 347/101, 102, 347/105

[56] References Cited

U.S. PATENT DOCUMENTS

| | | | |
|---|---|---|---|
| 4,402,262 | 9/1983 | Handforth | 101/129 |
| 4,772,518 | 9/1988 | Marthe | 428/511 |
| 4,832,984 | 5/1989 | Hasegawa et al. | 427/162 |
| 4,973,617 | 11/1990 | Incontro et al. | 524/187 |
| 5,106,417 | 4/1992 | Hauser et al. | 106/20 |

FOREIGN PATENT DOCUMENTS

| | | | |
|---|---|---|---|
| 0 233 039 A2 | 8/1987 | European Pat. Off. | B41M 1/30 |
| 30 18 342 A1 | 11/1980 | Germany | B41M 1/42 |
| 6-155892 | 6/1994 | Japan | B41M 5/00 |
| 61-102286 | 11/1994 | Japan | B41M 5/00 |
| 2 008 034 | 5/1979 | United Kingdom | B41M 1/26 |

*Primary Examiner*—Valerie Lund

[57] ABSTRACT

A durable image is formed by printing a pigmented aqueous ink onto a substrate bearing a hydrophilic thermoplastic polymer having cross-linking groups, then heating the printed image to encapsulate the pigment and cross-link the polymer.

10 Claims, No Drawings

PROCESS FOR PROVIDING DURABLE IMAGES ON A PRINTED MEDIUM

FIELD OF THE INVENTION

This invention relates to a process for providing printed images using ink-jet printing, and more particularly, to a process for providing printed images having excellent durability, water-fastness and smear fastness.

BACKGROUND OF THE INVENTION

Ink-jet printing is a non-impact method for recording information in response to an electronic signal, such as that generated by a computer. In the printer, the electronic signal produces droplets of ink that are deposited on a substrate, typically paper. Ink-jet printers have found broad commercial acceptance due to their rapid printing speeds, relatively quiet operation, graphic capability and low cost.

In current ink-jet printing applications, several inks (typically black, cyan, magenta and yellow) are used to print textual and graphic information on a printing medium, typically ordinary paper. The inks primarily are composed of water, and contain a colorant that may be a dye or pigment dispersion. Pigment dispersions are preferred since dyes fade on exposure to light, with the pigment dispersions offering greatly improved light stability. The inks also generally contain a polyhydric alcohol to prevent nozzle clogging, and may contain various adjuvants. Such ink and ordinary paper are well suited for desk-top publishing, as currently practiced, wherein only a small portion of the paper receives printed text and graphic information.

It is also desired to use ink-jet technologies to reproduce high quality colored pictoral information (such as photographs) in commercial printing and desktop publishing applications. In these applications, however, the printing medium will receive substantially more of the black and colored inks to accurately reproduce the various hues, tints, and colors contained in a typical colored picture. For example, the printing medium will be expected to receive up to 200% or more coverage in conventional commercial printing.

Ordinary paper is not suitable for such high quality applications for a number of reasons. Current special ink-jet media employ vehicle absorptive components to bind the dyes to the media. The purpose is to reduce bleed, whereby the intrusion of one color into an adjacent color is minimized. As a consequence current media are inherently moisture sensitive, can be quite fragile to handling, and are subject to finger smearing. Moreover, the vehicle absorptive components usually are water soluble polymers, which result in slower printing speeds. In addition the water absorptive components leave the paper quite sensitive to moisture and smearing.

Thus, a need exists for a process that will provide a printed image having excellent durability, water-fastness, and smear resistance in both imaged and non-imaged areas. A specific need exists for such a process capable of reproducing colored pictorial information in high quality, thereby meeting the demanding requirements of commercial printing.

SUMMARY OF THE INVENTION

The present invention provides a process for forming a durable, printed image by, in sequence:

(a) providing a printing medium comprising a substrate that bears a hydrophilic thermoplastic polymeric coating containing at least one crosslinkable thermoplastic polymer having a molecular weight of at least 6,000, at least one carboxylic acid group, and at least one cross-linkable group;

(b) printing an aqueous ink image on the thermoplastic polymeric coating; and (c) heating the printed image to a temperature in the range of approximately 100° to 190° C. for about 5 seconds to 30 minutes to sequentially (1) soften said polymeric coating and encapsulate the ink colorant, and (2) cross-link said polymeric coating to form a hydrophobic matrix.

The coating may constitute a single thermoplastic polymer having both the carboxylic acid group(s) and cross-linkable group(s), or may constitute a mixture of polymers wherein these groups are present as constituents of different polymers. The invention may be practiced with inks containing pigment or dye colorants. In preferred embodiments, the medium coating also contains a neutralizing component that inhibits cracking of the cured coating.

The process has general utility in printing applications, and has special utility in demanding ink-jet printing applications involving printing of pictoral information in addition to text. Thus, the process has particular utility in commercial printing.

DETAILED DESCRIPTION OF THE INVENTION

PRINTING MEDIUM

The printing medium (i.e., ink-jet recording sheet) used in practicing the invention constitutes a substrate that supports a hydrophilic coating comprising a cross-linkable thermoplastic polymer having a molecular weight of at least 6,000. The thermoplastic polymer may be one polymer, which has at least one carboxylic acid group and at least one cross-linkable group, or a mixture of compatible polymers that individually have the carboxylic acid group(s) and cross-linkable group(s). As used herein, the term "hydrophilic" means that an aqueous ink carrier, which may contain organic components such as penetrants, will be absorbed into the thermoplastic polymeric coating, and the term "compatible" means that the mixture of polymers will form a uniform coating so that an image printed on the coating will not exhibit undue light-scattering that would detract from image quality. The mixture may either be a single phase, or a fine dispersion.

The thermoplastic polymeric coating is initially hydrophilic, so that it readily absorbs the aqueous ink carrier during the printing step. After printing, the coating softens upon heating to a temperature in the range of 100° to 190° C., and encapsulates the ink colorant. Then, the coating cross-links to form a durable hydrophobic matrix. Typically, the encapsulation and cross-linking will occur between 5 seconds and 30 minutes.

The hydrophilic property is provided by the presence of carboxylic acid groups on the selected thermoplastic polymer. The cross-linking property is provided by presence of a cross-linking group, typically hydroxyl, epoxy, amine, isocyanate, amide, and/or acrylamide group(s). To form a useful coating, the thermoplastic polymer, or mixture thereof, will have a molecular weight of at least 6,000, and preferably at least 10,000. Representative single polymers, which bear both the carboxylic acid and cross-linking groups, include interpolymers formed from 40% N-tert.-octyl acrylamide/34% methyl methacrylate/16% acrylic acid/6% hydroxypropyl methacrylate/4% t-butyl amino ethyl methacrylate and having a molecular weight of approximately 50,000.

When a blend is used, Component A is a hydrophilic, thermoplastic copolymer prepared from (1) acrylic acid, methacrylic acid, an olefinic dicarboxylic acid (e.g., maleic or itaconic acid), or an olefinic dicarboxylic anhydride (e.g., maleic or itaconic anhydride) copolymerized with (2) a lower alkyl (i.e., 1 to 6 carbon atoms) acrylate or methacrylate ester, dialkylamino acrylate or methacrylate, styrene, vinyl acetate, vinyl ethyl or methyl ether, vinyl pyrrolydone, ethylene oxide, or the like. Representative copolymers that may be selected to advantage include methacrylate (37%)/ethyl acrylate (56%)/acrylic acid (7%) terpolymer, acid no. 76–85, molecular weight 260,000; methyl methacrylate (61.75%)/ethyl acrylate (25.75%)/acrylic acid (12.5%) terpolymer, acid no. 100, molecular weight 200,000; styrene/maleic anhydride half ester copolymers, with styrene to maleic anhydride ratios of 1.4/1 to 1.0/1 and molecular weights from 60,000 to 215,000; poly(methyl vinyl ether/maleic acid); etc. An acrylic polymer containing alkylaminoethylmethacrylate, such as a copolymer of butyl methacrylate/dimethylaminoethyl methacrylate, (80/20), average molecular weight 11,000, also may be selected. Useful copolymers are readily prepared using conventional polymerization techniques such as solution polymerization, emulsion polymerization, etc.

Component B of the blend provides the cross-linking groups. Representative compounds that may be selected for this purpose include polyvinyl alcohol, cellulose compounds such as polyhydroxyethyl cellulose and polyhydroxymethyl cellulose, melamine-formaldehyde resins, epoxy resins, polyamides, polyamines, polyisocyanates, polyacrylamides, and polyvinyl pyrrolidone. The amount of Component B is not critical, but will be an amount effective to cross-link Component A during the post-printing heat treatment, after Component A has at least partially encapsulated the ink colorant. The weight ratio of Component A to Component B generally will be in the range of 20/80 to 80/20, preferably 30/70 to 70/30. A weight ratio of 50/50 generally will provide the desired results.

In a preferred embodiment, the coating also will contain a neutralizing component to minimize or avoid cracking of the cured coating. Volatile compounds (e.g., ammonia; N,N-dimethylethanolamine; triethanol amine; 2-amino-2-methyl propanol) providing 20 to 100%, preferably 40 to 100%, neutralization may be selected to adjust pH of the coating solution above 4.0, which has been found to be advantageous. Generally, presence of 2 to 8% neutralizing component in the coating solution will be effective for this purpose.

The coating also may contain an inorganic filler, such as silica or silicates, zeolites, calcined kaolins, diatomaceous earth, barium sulfate, aluminum hydroxide, or calcium carbonate. The ratio of filler to polymer will vary with the particular components, but generally will be restricted to levels that do not cause dusting of the coating. Surfactants, plasticizers, humectants, UV absorbers, polymeric dispersants, defoamers, mold inhibitors, antioxidants, latex, dye mordants, optical brighteners, and other additives may be included for conventional purposes. Generally the coating will contain the thermoplastic polymer, or mixture of Components A and B described above, in the amount of 60 to 100%, preferably 80 to 100%, by weight of the total coating composition.

MEDIUM PREPARATION

The coating is applied to a sheet support surface in a dry coating weight range of 2 g/M$^2$ to about 10 g/M$^2$ for low coverage images. At a dry coating weight of less than 2 g/M$^2$, the ink spread during printing generally is too great. Appropriate coating weight is needed to provide sufficient absorbing capacity to prevent ink spread and/or puddling and to minimize cockle with porous substrates. Thus, the coating weight range for high coverage images should be about 5 to 20 g/M$^2$, preferably about 8 to 15 g/M$^2$. The coating may be applied to the support using conventional coating techniques such as roller coating or knife coating (e.g., air knife or trailing blade).

The medium substrate will be selected in accordance with the intended application. Paper substrates, such as porous copier grades or non-porous polyethylene coated grades, generally will be selected for ink-jet printing applications. Non-porous substrates, such as Mylar® polyester film, may be selected if the medium will be viewed with an overhead projector. Other substrates, such as cardboard, polyclad papers, or fabrics, may be selected for specialty applications.

APPLICATION

The medium is particularly adapted for use with commercial aqueous ink-jet inks employing a pigment or dispersed dye colorant, but also may be used with inks having a dye colorant. The pigmented inks generally will contain a polymeric dispersant, such as the block copolymer dispersant described in U.S. Pat. No. 5,085,698, and in EP Application No. 0556649A1 published Aug. 28, 1993, or a random or graft polymeric dispersant. Various additives and cosolvents generally are also present, as described in U.S. Pat. No. 5,272,201, to improve ink drying time against other conventional purposes.

Ink is applied to the coated medium using conventional techniques such as thermal or bubble jet printers, piezoelectric printers, continuous flow printers, or valve jet printers. Then, the medium is cured for 5 seconds to 30 minutes at a temperature in the range of 100° to 190° C., with shorter times being required at the higher temperatures. The desired results generally are achieved by heating to 140° to 180° C. for 30 seconds to 5 minutes. An oven or radiant heater may be used for this purpose. During curing, the thermoplastic polymer present in the medium coating softens and at least partially encapsulates the ink colorant, followed by cross-linking. The resulting printed image is durable, water-fast and smear resistant. The process is particularly useful for the printing of pictorial information, as well as text and graphic information, in commercial printing or desk-top applications, as well as wide format applications such as printing of signs, banners and the like.

The invention will be further illustrated by, but not limited to, the following examples

EXAMPLES

The inks used in the examples had the following compositions and were prepared using a procedure similar to that described in Example 1 of U.S. Pat. No. 5,310,778.

Cyan Ink:

| INGREDIENT | AMOUNT (%) |
|---|---|
| Monolite ® GT 751D, Zeneca, Wilmington, DE | 0.81 |
| Endurophthal Blue BT-617D, Cookson Pigments, Inc., Newark, NJ | 2.19 |
| Butyl methacrylate/methyl methacrylate// | 2.00 |

-continued

Cyan Ink:

| INGREDIENT | AMOUNT (%) |
|---|---|
| methacrylic acid, (BMA/MMA//MAA) (10/5//10)[1] | |
| Diethylene glycol | 4.50 |
| Liponics ® EG-1, Lipo Chemical Co., Paterson, NJ | 5.00 |
| Multranol ® 4012, Miles, Inc., Pittsburgh, PA. | 2.50 |
| Dantocol ® DHE, Lonza Inc., Fairlawn, NJ | 1.00 |
| Deionized water | 82.00 |

The ink had a pigment to dispersant ratio of 1.5:1.

Magenta Ink:

| INGREDIENT | AMOUNT (%) |
|---|---|
| Quindo ® Magenta RV6803, Miles, Inc., Pittsburgh, PA. | 3.045 |
| Indofast ® Brilliant Scarlet R6300, (Pigment Red 163, C.I. No. 71145), Miles, Inc., Pittsburgh, PA. | 0.455 |
| Butyl methacrylate/methyl methacrylate// methacrylic acid, (BMA/MMA//MAA) (10/5//10)[1] | 2.33 |
| Tetra-ethylene glycol | 8.70 |
| 2-pyrrolidone | 5.25 |
| Multranol ® 4012, Miles, Inc., Pittsburgh, PA. | 2.50 |
| Dantocol ® DHE, Lonza Inc., Fairlawn, NJ | 0.50 |
| Deionized water | 77.22 |

The ink had a pigment to dispersant ratio of 1.5:1.

Yellow Ink:

| INGREDIENT | AMOUNT (%) |
|---|---|
| Cromothal ® 8GN pigment, Ciba Geigy, Scarsdale, NY. | 5.00 |
| Butyl methacrylate/methyl methacrylate// methacrylic acid, (BMA/MMA//MAA) (10/5//10)[1] | 5.00 |
| Tetra-ethylene glycol | 4.00 |
| Liponics ® EG-1, Lipo Chemical Co., Paterson, NJ | 5.00 |
| 2-pyrrolidone | 6.00 |
| Deionized water | 72.50 |

[1]Polymer 3 in U.S. Pat. 5,310,778. Made as described therein.

The ink had a pigment to dispersant ratio of 1:1.

Black Ink:

| INGREDIENT | AMOUNT (%) |
|---|---|
| Raven Black pigment, Columbian Chemical Co., Jamesburg, NJ | 3.60 |
| Butyl methacrylate/methyl methacrylate// methacrylic acid, (BMA/MMA//MAA) (10/5//10)[1] | 2.00 |
| Diethylene glycol | 5.70 |
| Liponics ® EG-1, Lipo Chemical Co., Paterson, NJ | 5.70 |
| N-methylpyrrolidone | 0.90 |
| Nuosept ® 95, Huls America Inc., Piscataway, NJ | 0.49 |
| Proxel ® GXL | 0.24 |
| Deionized water | 81.67 |

The ink had a pigment to dispersant ratio of 1.8:1.

Example 1

A 6% aqueous solution of Carboset® 526 was prepared by adding 12 gm of Carboset® 526 and 2 gm of 12M ammonia into 150 gm of deionized water. After stirring to dissolve the solids more water was added to make 200 grams of solution.

| INGREDIENTS | AMOUNT (PARTS BY WEIGHT) |
|---|---|
| Polyvinylpyrrolidone, K-30, (6% solution) | 60 |
| Carboset ® 526, (B. F. Goodrich, Cleveland, Ohio) | 20 |
| Methylhydroxypropyl cellulose, MHPC-25 (2% solution) (Aqualon, Wilmington, DE) | 20 |

The solution was coated on 200 micron ED treated polyethylene terephthalate film to form an ink-jet media.

The ink-jet media was printed using an HP 550C printer, with the aqueous pigment-based cyan, magenta, yellow and black inks outlined above, and dried. The media was baked in the oven for 5 min. at 180° C. Both the media and printed ink displayed significant improvement in smear resistance.

Results are shown in Table 1 below.

TABLE 1

| Bake Time at 180° C. (Min) | Flush under tap water |
|---|---|
| 0 | After 20 sec. Printed ink and coated media are all completely washed away. |
| 5 | Printed ink and media remained after a 5 min flush. Printed ink is partially washed away. |
| 10 | Printed ink and coated media remained. After 5 min., most of the printed ink remained. |

Example 2

Four hydrophilic coating solutions having the following compositions were prepared:

| | AMOUNT (PARTS BY WEIGHT) | | | |
|---|---|---|---|---|
| INGREDIENTS | SOLN. A | SOLN. B | SOLN. C | SOLN. D |
| Polyvinyl alcohol (6% solution) | 80 | 70 | 50 | 30 |
| Carboset ® 526 as in Example 1 | 20 | 30 | 50 | 70 |

The solutions were coated on 200 micron ED treated polyethylene terephthalate film to form an ink-jet media. The media was printed with pigment-based inks and the printed image was dried as described in Example 1.

Smear resistance was tested by using a wet Q-tip. The Q-tip was wetted by dipping the tip in water until the cotton ball of Q-tip was saturated with water. Then the wet Q-tip was rubbed against the area with and without printed ink of the media. The number of passes required to rub off the printed ink in the printed areas and the number of passes required to remove the hydrophilic coating in the unprinted areas of the media was determined.

Results are shown in Table 2 below.

TABLE 2

| Post-heat | # Of Wet Q-Tip Passes | | | | | | | |
|---|---|---|---|---|---|---|---|---|
| | Sample A | | Sample B | | Sample C | | Sample D | |
| Curing | ink | media | ink | media | ink | media | ink | media |
| None | 2 | 13 | 2 | 20 | 2 | 21 | 2 | 19 |
| 180° C., 5 min. | 19 | 100+ | 30 | 100+ | 93 | 100+ | 70 | 100+ |

Example 3

A 9% solution of polyvinyl alcohol and a 9% solution of Poly(methyl vinyl ether/maleic acid) were mixed in different ratios to form hydrophilic coating solution as follows:

| | AMOUNT (PARTS BY WEIGHT) | | | |
|---|---|---|---|---|
| INGREDIENTS | SOLN. A | SOLN. B | SOLN. C | SOLN. D |
| Polyvinyl alcohol (9% solution) | 50 | 70 | 80 | 90 |
| Poly(methyl vinyl ether/maleic acid) (9% solution) | 50 | 30 | 20 | 10 |

10 micron thick coatings of these solutions were made on 200 micron thick ED treated polyethylene terephthalate and labeled as Samples A, B, C, and D.

Samples A, B, C, and D were then printed with pigmented ink and dried as described in Example 1. The water resistance of printed image on the media was tested as described in Example 2.

Results are shown in Table 3.

TABLE 3

| Post-heat | # Of Wet Q-Tip Passes | | | |
|---|---|---|---|---|
| Curing | Sample A | Sample B | Sample C | Sample D |
| None | 2 | 2 | 2 | 2 |
| 180 C, 1 min. | 73 | 33 | 27 | 4 |

Example 4

A 9% solution of polyvinyl alcohol and a 9% solution of Poly(methyl vinyl ether/maleic acid) having varied amounts of concentrated ammonia were mixed in a 50:50 ratio to form five hydrophilic coating solutions, Samples A–E. Concentrated ammonia of 0 gm, 0.30 gm, 0.60 gm, 0.75 gm and 1.5 gm were added respectively into 100 gm of solution Samples A–E.

The solutions were coated on 200 ED treated polyethylene terephthalate and dried to a thickness of 10 micron to form 5 ink-jet media samples labeled as Sample A, B, C, D, and E. The samples were printed with pigmented ink as described in Example 1. The printed image on the media labeled Sample A and B cracked very severely, with some cracking observed for Sample C and D, almost no cracking for Samples E with the media still maintaining its glossy appearance.

Example 5

Four hydrophilic coating solutions were prepared by mixing, in a 50:50 ratio, Carboset® 526 having a molecular weight of 200,000 and polyvinylpyrrolidone having molecular weights of 10,000, 40,000, 220,000, 700,000, respectively.

These solutions were coated on 200 micron thick ED treated polyethylene terephthalate to give Sample A (PVP, MW: 10,000), Sample B (PVP, MW: 40,000), Sample C (PVP, MW: 220,000) and Sample D (PVP, MW: 700,000) having a dry thickness of 10 microns.

Samples A, B, C and D were then printed with ink and dried as described in Example 1. The printed ink and media were tested for smear resistance using the wet Q-tip rub test, before and after post curing at 180° C. for 5 min. Results are shown in Table 4.

TABLE 4

| Post-heat | # Of Wet Q-Tip Passes | | | | | | | |
|---|---|---|---|---|---|---|---|---|
| | Sample A | | Sample B | | Sample C | | Sample D | |
| Curing | ink | media | ink | media | ink | media | ink | media |
| None | 1 | 8 | 1 | 4 | 1 | 20 | 1 | 20 |
| 180° C., 5 min. | 6 | 100+ | 4 | 100+ | 8 | 100+ | 27 | 100+ |

Example 6

Samples were prepared as described for Sample A in Example 4 and tested as described in Example 4 at temperatures and times for postcuring shown in Table 5. Results are shown in Table 5.

TABLE 5

| Postcuring | # Of Wet Q-Tip Passes | |
|---|---|---|
| Temp (°C.)/Time (min) | Ink | Media |
| 0 | 2 | 8 |
| 100/10 | 20 | 30 |
| 130/10 | 100+ | 100+ |
| 160/10 | 100+ | 100+ |
| 180/10 | 100+ | 100+ |

Example 7

Example 2 was repeated with the following exception: the media were printed with a dye-based ink and postcured with infrared (IR) heat at 150° C. for 5 min. Results are shown in Table 6.

TABLE 6

| Post-heat | # Of Wet Q-Tip Passes | | | | | | | |
|---|---|---|---|---|---|---|---|---|
| | Sample A | | Sample B | | Sample C | | Sample D | |
| Curing | ink | media | ink | media | ink | media | ink | media |
| None | 5 | 20 | 5 | 21 | 12 | 17 | 10 | 19 |
| 180° C., 5 min. | 11 | 55 | 21 | 100 | 46 | 90 | 85 | 100 |

Example 8

A 9% solution of polyvinyl alcohol and a 9% solution of Poly(methyl vinyl ether/maleic acid) having varied amounts of concentrated dimethylamine ethanol were mixed in a 50:50 ratio to form five hydrophilic coating solutions, Samples A–E. N,N-dimethylamineethanol was present in the amount of 0.15 gm, 0.30 gm, 0.45 gm, 0.60 and 0.75 gm in Samples A–E, respectively.

The solutions were coated on 200 ED treated polyethylene terephthalate and dried to a thickness of 10 micron to form 5 ink-jet media samples labeled as Sample A, B, C, D, and E. The samples were printed with pigmented ink as described in Example 1. All cracking of the printed ink image was eliminated. Smear resistance of the ink decreased, as evidenced by the # of wet Q-tip passes, from 100+ for Sample A to 26 for Sample E as the N,N-dimethylamineethanol increased from 0.15 gm to 0.75 gm in the samples.

Example 9

The following solutions were prepared: 3.15 grams of concentrated ammonium hydroxide (29%) were added to 87.85 grams of water. 9.00 grams of Scripset® 640 resin (styrene/maleic anhydride copolymer, with styrene/maleic anhydride ratio=1.4, and molecular weight=215,000 were then dissolved in this solution. A second solution was prepared by dissolving 9.00 grams of polyvinyl alcohol (88% hydrolysis grade) in 91.00 grams of water. 31.50 grams of the Scripset® containing solution were then mixed with 38.50 grams of the polyvinyl alcohol solution to make a coating solution. The coating solution was coated on 100 micron thick gel subbed polyethylene terephthalate film using a 254 micron doctor blade coating knife, to give a dry coating weight of about 150 mg/dm$^2$.

Yellow, magenta, cyan, and black pigmented ink-jet inks described earlier were printed on the media in patterns for testing smear resistance and media durability. Printing was done with a Hewlett-Packard 550-C ink-jet printer. The printed patterns were tested for ink smear resistance as described in Example 2. After the printed media sample was tested, it was placed in a 180° C. oven for 1 minute to durabilize the image and media. The sample was then retested. Results are shown in Table 7.

TABLE 7

| Post-heat | # Of Wet Q-Tip Passes | |
|---|---|---|
| Curing | ink | media |
| None | 3 | 23 |
| 180° C., 1 min. | 77 | 100+ |

The results show that the ink image became much more smear resistant as a result of heating the imaged media. Media durability also improved.

Example 10

1.20 grams of concentrated ammonium hydroxide (29%) were added to 89.80 grams of water. In this was dissolved 9 grams of Carboset® 526 resin. A second solution was prepared by dissolving 10 grams of polyvinyl alcohol (88% hydrolysis grade) in 90 grams of water. 29.17 grams of the Carboset® solution were then mixed with 35.00 grams of the polyvinyl alcohol solution and 0.87 grams of Epon® 828 liquid epoxy resin (epoxide equivalent weight=185 to 192), manufactured by Shell Chemical Company, to make a coating solution. The coating solution was coated on 100 micron thick gel subbed polyethylene terephthalate film using a 254 micron doctor blade coating knife, to give a dry coating weight of about 150 mg/dm$^2$.

This media sample was printed with the pigmented ink-jet inks described earlier and tested the same way as in Example 2. Results are shown in Table 8.

TABLE 8

| Post-heat | # Of Wet Q-Tip Passes | |
|---|---|---|
| Curing | ink | media |
| None | 2 | 18 |
| 180° C., 1 min. | 71 | 100+ |

The results show that the ink image became much more smear resistant as a result of heating the imaged media. Media durability also improved.

Example 11

A 9% solution of Poly (methyl vinyl ether/maleic acid) was coated on 200 ED treated polyethylene terephthalate film with dry thickness of 15 micron as an ink-jet media. The media was printed with pigmented inks as described in Example 1. The wet Q-tip smear resistance for the pigmented ink was increased from 2 to 100 rubs after heating in the oven at 180° C. for 1 min.

Example 12

A coating was prepared by dissolving 30 g. of an interpolymer formed from 40% N-tert.-octyl acrylamide/34% methyl methacrylate/16% acrylic acid/6% hydroxypropyl methacrylate/4% t-butyl amino ethyl methacrylate and having a molecular weight of approximately 50,000, in 120 g methanol. It was coated, at 5.08 microns (2 mils) wet thickness, on a Dylux® paper, E. I. DuPont de Nemours and Co., Wilmington, Del., using an 8" wide doctor blade. The dried film was then printed with a magenta and black ink image on an HP 550C printer manufactured by Hewlett-Packard. The inks had the following composition and were prepared as described earlier:

| Ink INGREDIENT | Black Ink AMOUNT (%) | Magenta |
|---|---|---|
| Diethylene glycol | 8 | 8 |
| Trimethylolpropane | 10 | 10 |
| Ethylene glycol | 10 | 10 |
| Quindo ® Magenta RV6803, Miles, Inc., Pittsburgh, PA. | — | 5.4 |
| Raven Black pigment, Columbian Chemical Co., Jamesburg, NJ | 7.5 | — |
| Butyl methacrylate/methyl methacrylate//methacrylic acid, (BMA/MMA//MAA) (10/5//10)[1] | 5.0 | 3.6 |
| Deionized water | 59.5 | 63 |

[1]Polymer 3 in U.S. Pat. 5,310,778. Made as described therein.

The printed image was subjected to wet rubbing and drip tests.

Unheated sample:

A drip test was conducted by holding the sample at a 45 degree angle and dripping water onto its surface and allowing it to run down the sample. Ink ran in the drip test. Ink also ran after 1–2 wipes with wet Q-tip.

Heated Sample:

The magenta and black ink printed samples were each heated for 2 min and 7 minutes at 125° C. and 175° C., respectively. The drip test described above was conducted. All samples were waterfast, with no color runs noticed.

The wipe test consisted of wiping with a Q-tip. The number of wipes completed prior to smearing of the image was recorded. Results are shown in Table 9.

TABLE 9

| HEATING CONDITIONS | | |
|---|---|---|
| TEMPERATURE (°C) | TIME (MINS) | # OF Q-TIP WIPES |
| 125 | 2 | Black Sample = 10 |
| 125 | 7 | Black Sample = 12 |
| 125 | 2 | Magenta Sample = 20 |
| 125 | 7 | Magenta Sample = 50 |
| 175 | 2 | Black Sample = 100+ |
| 175 | 7 | Black Sample = 100+ |
| 175 | 2 | Magenta Sample = 100+ |
| 175 | 7 | Magenta Sample = 100+ |

What is claimed is:

1. A process for forming a durable printed image comprising, in sequence:

(a) providing a printing medium comprising a substrate that bears a hydrophilic thermoplastic polymeric coating containing at least one crosslinkable thermoplastic polymer having a molecular weight of at least 6,000, at least one carboxylic acid group, and at least one cross-linkable group;

(b) printing an aqueous ink image on the thermoplastic polymeric coating; and (c) heating the printed image to a temperature in the range of approximately 100° to 190° C. for about 5 seconds to 30 minutes to sequentially (1) soften said coating and at least partially encapsulate the ink colorant, and (2) cross-link the coating to form a hydrophobic matrix.

2. The process of claim 1 wherein said polymeric coating comprises a single thermoplastic polymer having at least one carboxylic acid group and at least one cross-linkable group selected from the group consisting of hydroxyl, epoxy, amine, isocyanate, amide, and acrylamide groups.

3. The process of claim 1 wherein said polymeric coating comprises a mixture of (A) a hydrophilic thermoplastic copolymer prepared from (1) acrylic acid, methacrylic acid, an olefinic dicarboxylic acid, or an olefinic dicarboxylic anhydride, and (2) a lower alkyl acrylate or methacrylate ester, dialkylamino acrylate or methacrylate, styrene, vinyl acetate, vinyl ethyl or methyl ether, vinyl pyrrolydone, or ethylene oxide; and (B) a compound having cross-linking groups.

4. The process of claim 3 wherein Compound (B) is polyvinyl alcohol, a cellulose compound, a melamine-formaldehyde resin, an epoxy resin, a polyamide, a polyamine, a polyisocyanate, a polyacrylamide, or polyvinyl pyrrolidone.

5. The process of claim 4 wherein the weight ratio of Component A to Component B is in the range of 20/80 to 80/20.

6. The process of claim 1 wherein said thermoplastic polymeric coating contains a neutralizing component in the amount of 2 to 8% by weight, based on total coating composition.

7. The process of claim 6 wherein the neutralizing component is selected from the group consisting of ammonia, N,N-dimethylethanolamine, triethanol amine and 2-amino-2-methyl propanol.

8. The process of claim 1 wherein the heating of step (c) is in the range of 140° to 180° C.

9. The process of claim 8 wherein the heating is for 30 seconds to 5 minutes.

10. The process of claim 1 wherein said aqueous ink contains a pigment and a polymeric dispersant.

* * * * *